US008932155B2

(12) United States Patent
Moore

(10) Patent No.: US 8,932,155 B2
(45) Date of Patent: Jan. 13, 2015

(54) SPORTS BALL TRAINING ASSEMBLY

(76) Inventor: Richard Moore, Richmond, VA (US)

( * ) Notice: Subject to any disclaimer, the term of this patent is extended or adjusted under 35 U.S.C. 154(b) by 82 days.

(21) Appl. No.: 13/553,757

(22) Filed: Jul. 19, 2012

(65) Prior Publication Data

US 2013/0053188 A1 Feb. 28, 2013

Related U.S. Application Data

(60) Provisional application No. 61/634,445, filed on Mar. 1, 2012, provisional application No. 61/572,731, filed on Jul. 21, 2011.

(51) Int. Cl.

| | |
|---|---|
| ***A63B 69/00*** | (2006.01) |
| ***A63B 69/24*** | (2006.01) |
| ***A63B 69/20*** | (2006.01) |
| ***A63B 69/36*** | (2006.01) |
| ***A63B 69/38*** | (2006.01) |
| ***A63B 63/08*** | (2006.01) |
| *A63B 63/00* | (2006.01) |
| *A63B 71/02* | (2006.01) |

(52) U.S. Cl.

CPC ..... *A63B 63/083* (2013.01); *A63B 2069/0008* (2013.01); *A63B 2063/001* (2013.01); *A63B 69/004* (2013.01); *A63B 69/24* (2013.01); *A63B 2071/026* (2013.01); *A63B 2225/093* (2013.01); *A63B 69/205* (2013.01); *A63B 69/36* (2013.01); *A63B 2243/007* (2013.01); *A63B 2071/024* (2013.01); *A63B 69/38* (2013.01); *A63B 69/0091* (2013.01); *A63B 2225/105* (2013.01)

USPC ..... 473/423; 473/430; 473/422; 473/429

(58) Field of Classification Search

CPC ..... A63B 69/002; A63B 69/004; A63B 69/0002; A63B 69/0079; A63B 69/0091

USPC ..... 473/422, 423, 427, 429–431, 442, 444; 482/90, 83

See application file for complete search history.

(56) References Cited

U.S. PATENT DOCUMENTS

| | | | | | |
|---|---|---|---|---|---|
| 925,342 | A | * | 6/1909 | Johnson | 482/90 |
| 2,506,825 | A | * | 5/1950 | Carlson | 473/429 |
| 3,547,437 | A | * | 12/1970 | Andersen | 473/427 |
| 4,105,203 | A | * | 8/1978 | Cho | 473/429 |
| 4,173,340 | A | * | 11/1979 | Kanno | 473/575 |
| 4,561,661 | A | | 12/1985 | Walker et al. | |
| 4,616,834 | A | | 10/1986 | Davis | |
| 5,037,113 | A | | 8/1991 | Sowards | |
| 5,203,558 | A | * | 4/1993 | An | 473/423 |
| 5,435,572 | A | | 7/1995 | Covel | |
| 5,494,278 | A | * | 2/1996 | Linden | 473/427 |
| 5,618,039 | A | * | 4/1997 | Tsai et al. | 473/423 |

(Continued)

*Primary Examiner* — Mitra Aryanpour

(57) ABSTRACT

A sports ball training assembly for repetitively practicing sporting techniques in a small area, such as, hitting a golf ball, kicking a soccer ball, or batting a baseball. A telescoping arm attaches to the ball, extending and retracting to create different positions to strike the ball. A spring attaches to the telescoping arm. The spring has sufficient elasticity to return the ball to equilibrium position after the ball is propelled forward. The elasticity of the spring and the elevation of the ball can be adjusted by enclosing various sections of the spring with a tube that slides along the longitudinal axis of the spring. As the rigid tube moves along the spring, the spring's characteristics change. A second spring portion enhances stability and control of the ball, and allows the ball to return to the user. A base and a base shaft provide structure to the assembly.

15 Claims, 16 Drawing Sheets

(56) References Cited

U.S. PATENT DOCUMENTS

| | | | | |
|---|---|---|---|---|
| 5,795,251 | A * | 8/1998 | Andersen | 473/427 |
| 5,957,789 | A | 9/1999 | Ainscough et al. | |
| 6,390,939 | B1 * | 5/2002 | Palacios | 473/422 |
| 6,458,037 | B1 * | 10/2002 | Dixon, Jr. | 473/431 |
| 7,137,909 | B2 | 11/2006 | Ohle | |
| 7,186,192 | B1 * | 3/2007 | Suissa | 473/423 |
| 7,527,567 | B2 | 5/2009 | Ohle | |
| 7,775,912 | B2 * | 8/2010 | Aguirre | 473/423 |
| 7,811,183 | B1 | 10/2010 | Ohle | |
| 8,137,218 | B2 * | 3/2012 | Le niewicz | 473/430 |
| 8,262,516 | B2 * | 9/2012 | Fuentes | 473/429 |
| 2006/0035729 | A1 * | 2/2006 | Wang | 473/417 |
| 2011/0165969 | A1 * | 7/2011 | Gu | 473/423 |
| 2011/0183781 | A1 | 7/2011 | Chiu | |
| 2013/0053188 | A1 * | 2/2013 | Moore | 473/423 |
| 2013/0337945 | A1 * | 12/2013 | Marks et al. | 473/423 |

* cited by examiner

SPORTS BALL TRAINING ASSEMBLY

CROSS-REFERENCE TO RELATED APPLICATIONS

The present Utility patent application claims priority benefit of the U.S. provisional application for patent Ser. No. 61/634,445 filed on Mar. 1, 2012, and patent Ser. No. 61/572,731 filed on Jul. 21, 2011, both filed under 35 U.S.C. 119(e). The contents of these related provisional applications are incorporated herein by reference for all purposes to the extent that such subject matter is not inconsistent herewith or limiting hereof.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to sports training. More particularly, one or more embodiments of the invention relate to sports training with a ball.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a ball is a round, usually spherical but sometimes ovoid, object with various uses. It is used in ball games, where the play of the game follows the state of the ball as it is hit, kicked or thrown by players. Balls can also be used for simpler activities, such as catch, marbles and juggling.

Typically, a ball hitting machine carries the ball, or hangs the ball in a set elevation for hitting, kicking, or batting. When the ball is struck, the ball may return to its original position to receive repetitive blows.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A illustrates an exemplary base positioned onto an exemplary base portion, and an exemplary telescoping arm portion positioned in proximity, and FIG. 2B illustrates a close-up view of an exemplary tubular portion joined with an exemplary base portion, in accordance with an embodiment of the present invention;

FIG. 10A illustrates an exemplary sports ball training assembly with two balls, spring portions, and telescoping arm portions, and FIG. 10B illustrates an exemplary sports ball training assembly with four balls, spring portions, and telescoping arm portions, and FIG. 10C illustrates a variable configuration of an exemplary sports ball training assembly with four balls, spring portions, and telescoping arm portions.

Figure 1:
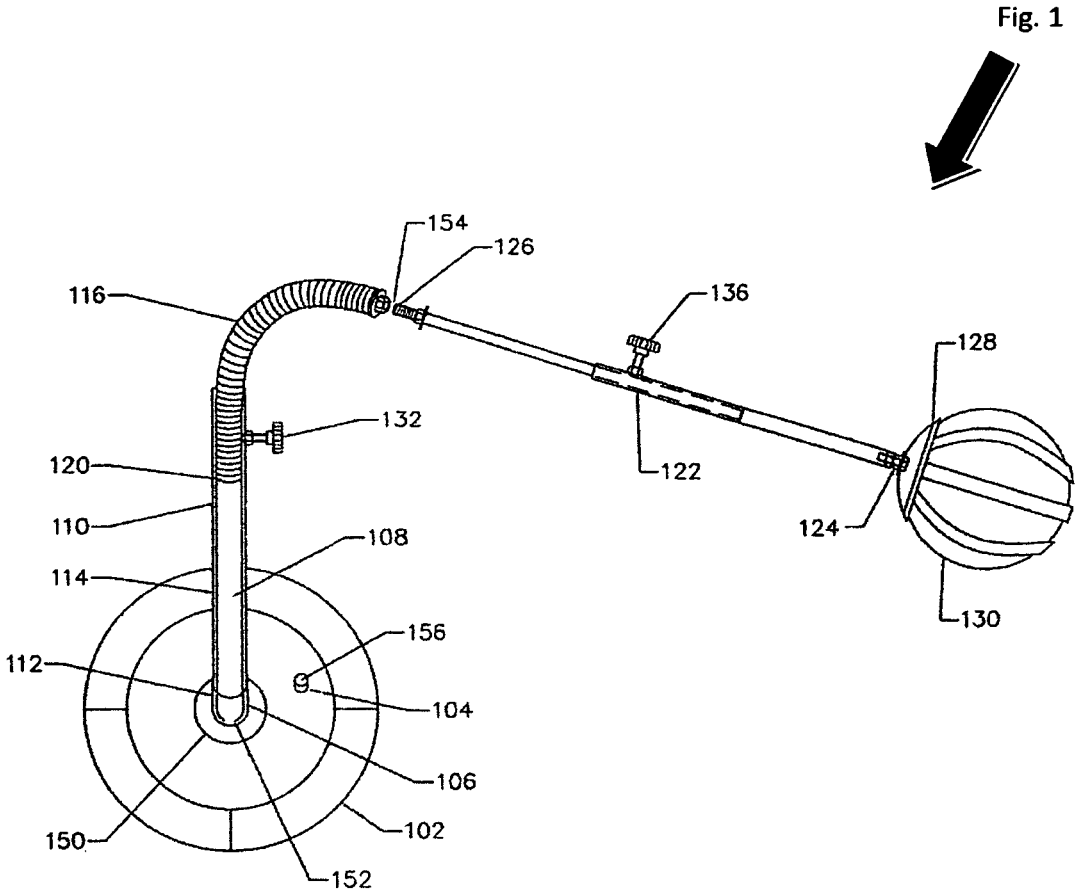
FIG. 1 illustrates a detailed perspective view of an exemplary sports ball training assembly, in accordance with an embodiment of the present invention.

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

The present invention will now be described in detail with reference to embodiments thereof as illustrated in the accompanying drawings. There are various types of sports ball training assemblies that may be provided by preferred embodiments of the present invention. In one embodiment, the sports ball training assembly 100 may be efficacious for repetitively practicing sporting techniques in a small area, such as, without limitation, hitting a golf ball, kicking a soccer ball, or batting a baseball. In some embodiments, a telescoping arm may attache to the ball, extending and retracting to create different positions to strike the ball. A spring portion may attach to the telescoping arm. The spring portion may include sufficient elasticity to return the ball to an equilibrium position after the ball is propelled to a forward position. The elasticity of the spring portion and the elevation of the ball may be adjusted by enclosing various sections of the spring portion with a tubular portion that slides along the longitudinal axis of the spring portion. As the rigid tubular portion moves along the spring portion, the spring portion's characteristics change. In some embodiments, a second spring portion enhances stability and control of the ball, and allows the ball to return to the user. A base and a base shaft provide structure to the assembly.

Those skilled in the art, in light of the present teachings, will recognize that the sports ball training assembly 100 may provide an assembly for repetitively striking a ball in a small area. The sports ball training assembly may be efficacious in improving ball-handling, developing motor skills, and providing entertainment. Through repetitive use of the sports ball training assembly, a user may practice different techniques for striking a ball in a small area. For example, without limitation, a baseball player may practice bunting the ball, or practice directional hitting. In some embodiments, the sports ball training assembly may have the ability to join with a variety of different sized and dimensioned balls at a telescoping arm portion. The telescoping arm portion may attach to a spring portion from the opposite end. The spring portion may include sufficient elasticity and compressibility to return the ball to an equilibrium position after the ball is propelled to a forward position. The sports ball training assembly may also allow the ball to be adjusted upward or downward from a ground surface to accommodate the user striking or propelling the ball about a stationary base. The elasticity of the spring portion may also be manipulated by enclosing various sections of the spring portion with a tubular portion, and traversing the spring portion along the longitudinal axis of the tubular portion. Positioning of the spring portion at various locations along the tubular portion may also create variable elevations, as described above, as the spring portion changes its characteristics as different sections are enclosed by the tubular portion.

In some embodiments, the sports ball training assembly may utilize a second spring portion 134 for enhanced stability and control of the ball. The second spring portion may also function to allow the ball to return to the user. Those skilled in the art will readily recognize, in light of the teaching of the present invention, that the sports ball training assembly may be lightweight, portable, and efficacious for practicing myriad sporting techniques, including, without limitation, hitting a golf ball, kicking a soccer ball, hitting a baseball, hitting a tennis ball with a racket, punching a ball, or kicking a moving ball for karate practice.

In some embodiments, the sports ball training assembly may securely join a ball to a ball end of a telescoping arm portion. The telescoping arm portion may extend and retract to create numerous positions from which to strike the ball. A telescoping arm fastener 136 may be utilized to secure the telescoping arm portion into a locked position. The telescoping arm portion may join, from an opposite spring end, with a spring portion. The spring portion may have sufficient elasticity to allow the ball to extend outwardly with the application of kinetic energy, and then compress back to an original equilibrium position. For example, without limitation, when the user strikes the ball, the kinetic energy propels the ball forward to a displaced position, before the spring portion's compressive forces return the ball to its original equilibrium position. In this manner, a user may execute various sport techniques in a limited area. Those skilled in the art, in light of the present teachings will recognize that Hooke's law of elasticity is an approximation that states that the extension of a spring is in direct proportion with the load applied to it, in this case, the ball. In one embodiment of the present invention, the elasticity of the spring portion, along with the elevation of the ball over a ground surface, may be variably adjusted by sliding the spring portion through a longitudinal axis of a rigid tubular portion. As greater portions of the spring portion are enclosed in the rigid tubular portion, the elasticity of the spring portion may decrease, and the elevation of the ball may rise. The tubular portion may secure in a predetermined position along the longitudinal axis of the spring portion with a fastener. In some embodiments, a base shaft 108 may provide an axial support for the sports ball training assembly. The base shaft may include a distal end 110 that joins to a support end 120 of the spring portion. In some embodiments, the base shaft may extend substantially vertically to elevate the ball. However, in other embodiments, the base shaft may extend horizontally from a wall. In some embodiments, the base shaft may extend perpendicularly from a base portion 102 at a base end 112. The base portion may provide a foundation for the base shaft. In some embodiments, the base portion may be filled with a weighted substance through an aperture 104, including, without limitation, sand, water, and stones so that the sports ball training assembly anchors in one position. An aperture nut 156 may cover the aperture. A reinforcing portion 106 may cover the base end and the base portion to provide additional resistance to the torque created when the ball is propelled forward. In some embodiments, the reinforcing portion may prevent said tubular portion and said base shaft from rotating when a substantial torque is applied to the sports ball training assembly. In one embodiment, a base plate 150 may be utilized to provide a horizontal foundational base for the base portion. A base plate nut 152 may secure the base plate to the ground surface.

FIG. 1 illustrates a detailed perspective view of an exemplary sports ball training assembly, in accordance with an embodiment of the present invention. In some embodiments, the sports ball training assembly may allow for repetitively striking a ball in a small area. Suitable materials for the sports ball training assembly may include, without limitation, steel, metal, aluminum, titanium, plastic, rubber, silicone, plastic, polyurethane, recyclable composite, and wood. In some embodiments, the sports ball training assembly may securely join a ball 130 to a ball end 124 of a telescoping arm portion 122. The ball may include, without limitation, a rubber ball, a leather ball, a baseball, a football, a soccer ball, a hockey puck, a golf ball, a croquet ball, and the like. However, in other embodiments, the ball may refer to any sports related member that is commonly propelled forward, including, without limitation, a hockey puck and a shuttlecock. A ball attachment portion 128 may act as a ball harness to securely join the ball to the telescoping arm portion. In some embodiments, the ball attachment portion may include a central shank with an annular flange at one end and a truncated conical section at the other end. A rod may pass through the ball to affix to the annular flange, thereby creating a secure attachment. However, in other embodiments, the ball may securely join with the ball attachment portion through various means, including, without limitation, a screw, a bolt, an adhesive, a rope passing through the ball, and an expanding anchor screw. Those skilled in the art will readily recognize, in light of the teaching of the present invention, that the ball may receive numerous large and impactful blows, thereby requiring a secure attachment to the ball attachment portion. Likewise, the ball attachment portion securely attaches to the ball end of the telescoping arm portion. In some embodiments, the telescoping arm portion may extend and retract to create numerous positions from which to strike the ball. The telescoping arm fastener may be utilized to secure the telescoping arm portion into a locked position. Possible fasteners may include, without limitation, a screw, a bolt, a washer, a magnet, and an adhesive. The telescoping arm portion may join, from an opposite spring end 126, with a spring portion 116. A joint 154 may provide flexibility between the telescoping arm portion and the spring end. In some embodiments, the telescoping arm portion may include a hook portion 144 for grasping the spring portion. In some embodiments, the spring end may include a threaded portion for screwing into the spring portion. The spring portion may include, without limitation, a coil, a spring, and a coiled metal. An impact end 118 of the spring portion joins with the spring end of the telescoping arm portion. In some embodiments, the spring portion may have sufficient elasticity to allow the ball to extend outwardly with the application of kinetic energy, and then compress back to an original equilibrium position. For example, without limitation, when the user strikes the ball, the kinetic energy propels the ball forward to a displaced position, before the spring portion's compressive forces return the ball to its original equilibrium position. In this manner, a user may execute various sport techniques in a limited area.

In some embodiments, the elasticity of the spring portion, along with the elevation of the ball over a ground surface, may be variably adjusted by traversing the spring portion along the longitudinal axis of a rigid tubular portion 114. The tubular portion may then enclose over different sections of the longitudinal axis of the spring. Those skilled in the art, in light of the present teachings will recognize that as greater portions of the spring portion are enclosed in the rigid tubular portion, the elasticity of the spring portion may decrease, and the elevation of the ball may rise. The tubular portion may secure in a predetermined position along the longitudinal axis of the spring portion with a tubular portion fastener 132. The tubular portion fastener may include, without limitation, a screw, a bolt, a washer, a magnet, and an adhesive. In some embodiments, the tubular portion fastener may include a hook for grasping the spring portion. In some embodiments, a base shaft 108 may provide an axial support for the sports ball training assembly. The base shaft may include a distal end that joins to a support end of the spring portion. In some embodiments, the distal end may include a threaded portion for screwing into the support end of the spring portion. However, in other embodiments, the base shaft may secure to the base portion with other means, including, without limitation, piercing through the base portion, an adhesive, a bolt, a clamp, and a magnet. In some embodiments, the base shaft may include a hook for grasping the spring portion. In some embodiments, the base shaft may extend substantially vertically to elevate the ball. However, in other embodiments, the base shaft may extend horizontally from a wall. In some embodiments, the base shaft may extend perpendicularly from a base portion at a base end. In some embodiments, the base portion may provide a foundation for the base shaft. In some embodiments, the base portion may be filled with a weighted substance through an aperture, including, without limitation, sand, water, and stones so that the sports ball training assembly anchors in one position. A reinforcing portion may cover the base end and the base portion to provide additional resistance to the torque created when the ball is propelled forward. The reinforcing portion may resist articulation of the base shaft towards the forward position, and causes the base shaft to return to an equilibrium position. In some embodiments, the reinforcing portion may include a metal band that overlays the base end, the tubular portion, and the base portion simultaneously, and secures to each with a fastener, such as, without limitation, a screw, a flanged nut, a washer, a bolt, a magnet, and an adhesive. The reinforcing portion may prevent the tubular portion and the base shaft from rotating when a substantial torque is applied to the sports ball training assembly. Suitable materials for the reinforcing portion may include, without limitation, rubber, metal, steel alloy, silicone, plastic, and polyurethane.

Those skilled in the art, in light of the present teachings, will recognize that the sports ball training assembly may allow the user to practice various sports activities, including, without limitation, repetitively bouncing a ball while using only a few feet of space, repetitively hitting a tennis ball with a racket while using only a few feet of space, repetitively hitting a baseball with a bat while using only a few feet of space, repetitively hitting a volleyball with the hands while using only a few feet of space, repetitively hitting or punching a ball with the fists while using only a few feet of space, repetitively making karate-type kicks at the ball at various heights above the ground for karate practice using only a few feet of space, repetitively making basketball shots with a ball at a basketball hoop while using only a few feet of space, repetitively kicking a football through a football, repetitively hitting or throwing a ball over an expandable net, and repetitively exercising legs, feet, and arms by continually hitting or kicking a ball.

Figure 2A:
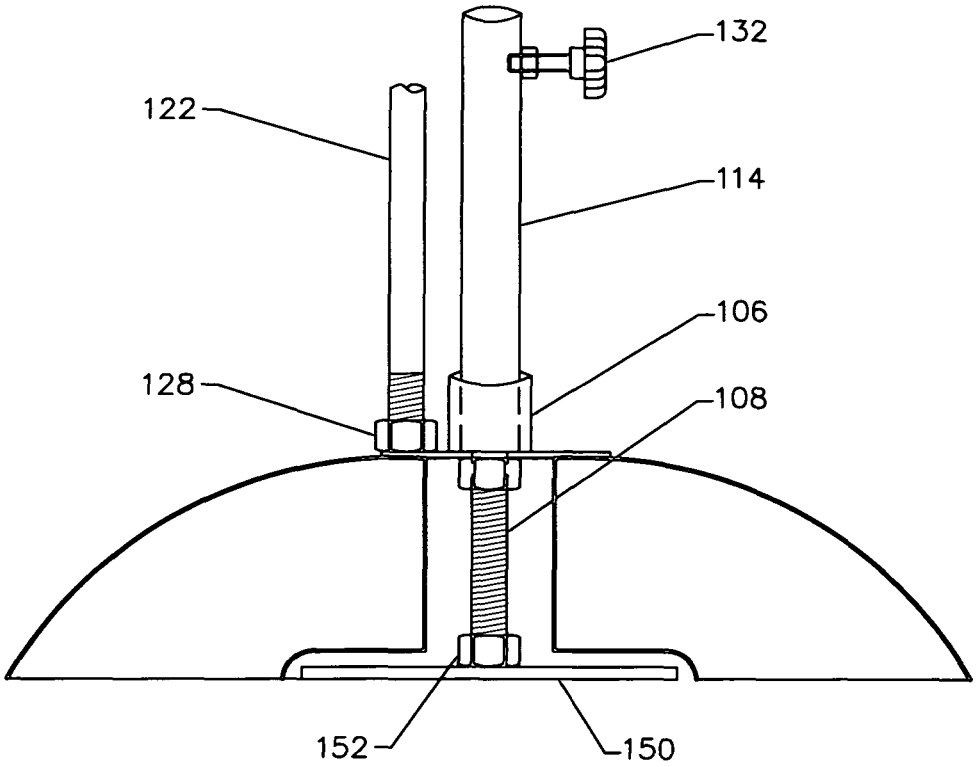
FIGS. 2A and 2B illustrate detailed perspective views of an exemplary base shaft and various attachments.
Figure 2B:
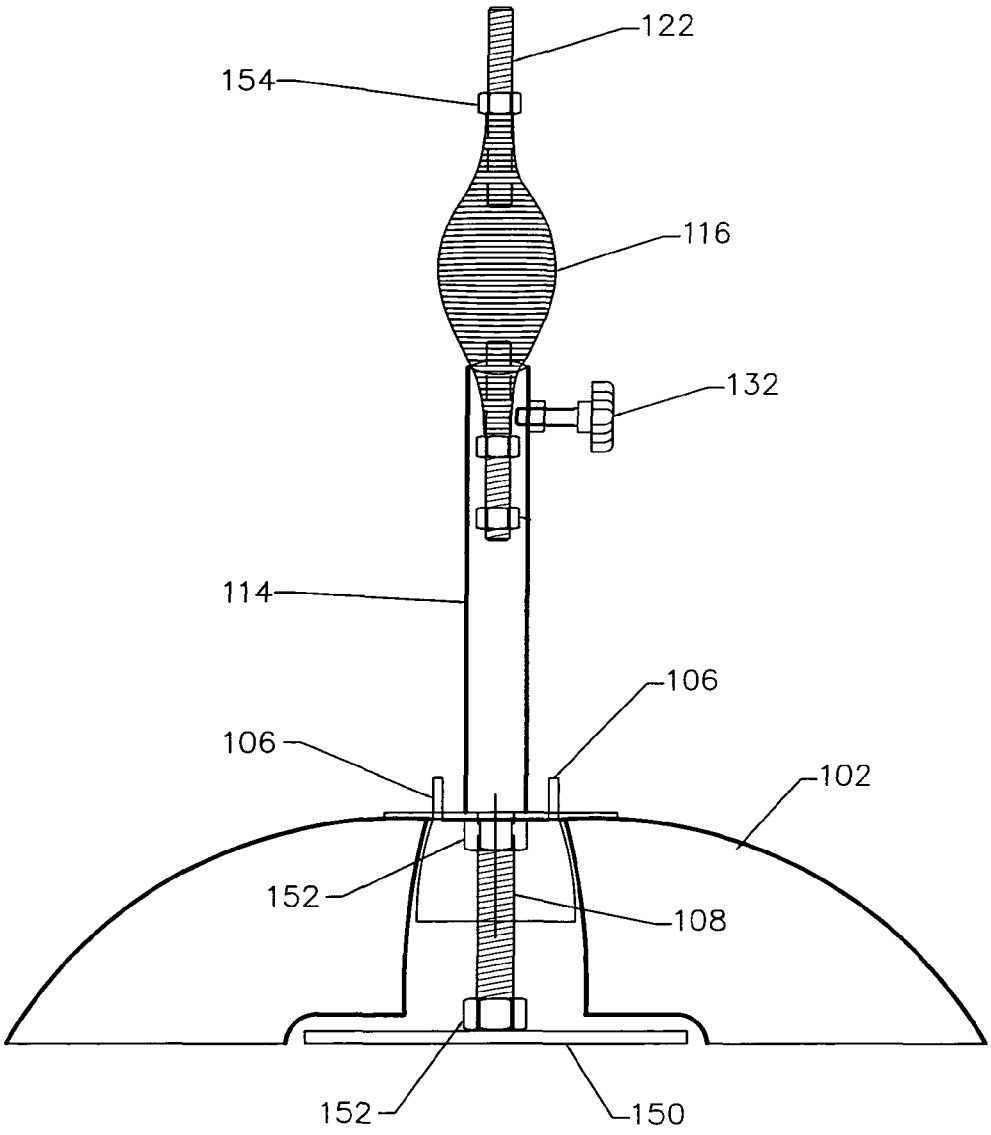

FIGS. 2A and 2B illustrate detailed perspective views of an exemplary base shaft and various attachments, FIG. 2A illustrates an exemplary base positioned onto an exemplary base portion, and an exemplary telescoping arm portion positioned in proximity, and FIG. 2B illustrates a close-up view of an exemplary tubular portion joined with an exemplary base portion, in accordance with an embodiment of the present invention. In some embodiments, the base shaft may extend perpendicularly from a base portion at a base end. However, in other embodiments, the base shaft may include a forty-five degree angle. The base portion may provide a foundation for the base shaft. In some embodiments, the base portion may be filled with a weighted substance through an aperture, including, without limitation, sand, water, and stones so that the sports ball training assembly anchors in one position. Those skilled in the art will recognize that the hollow nature of the base portion facilitates portability of the sports ball training assembly. However, in other embodiments, the base portion is solid. A reinforcing portion may cover the base end and the base portion to provide additional resistance to the torque created when the ball is propelled forward. Suitable materials for the reinforcing portion may include, without limitation, rubber, metal, steel alloy, silicone, plastic, and polyurethane.

Figure 3:
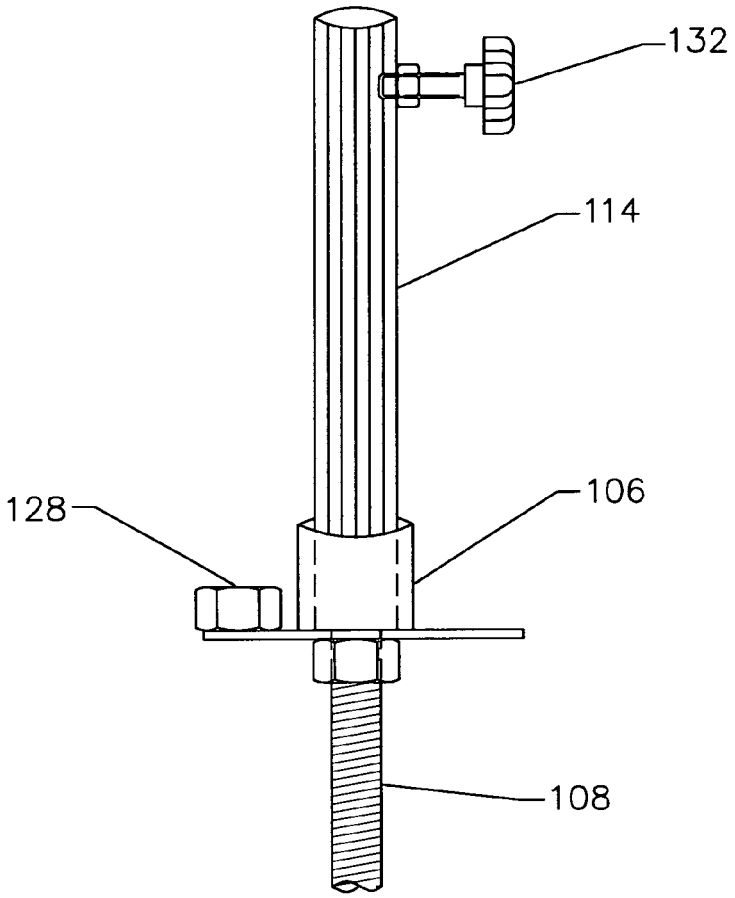
FIG. 3 illustrates a detailed perspective view of an exemplary tubular portion enclosed around an exemplary base shaft, and secured into position with an exemplary tubular portion fastener, in accordance with an embodiment of the present invention.

FIG. 3 illustrates a detailed perspective view of an exemplary tubular portion enclosed around an exemplary base shaft, and secured into position with an exemplary tubular portion fastener, in accordance with an embodiment of the present invention. In some embodiments, the tubular portion may include a tube, sufficiently dimensioned to snugly enclose the longitudinal axis of the base shaft and the spring portion. When a desired position for the tubular portion is achieved, the tubular portion fastener may lock the tubular portion.

Figure 4:
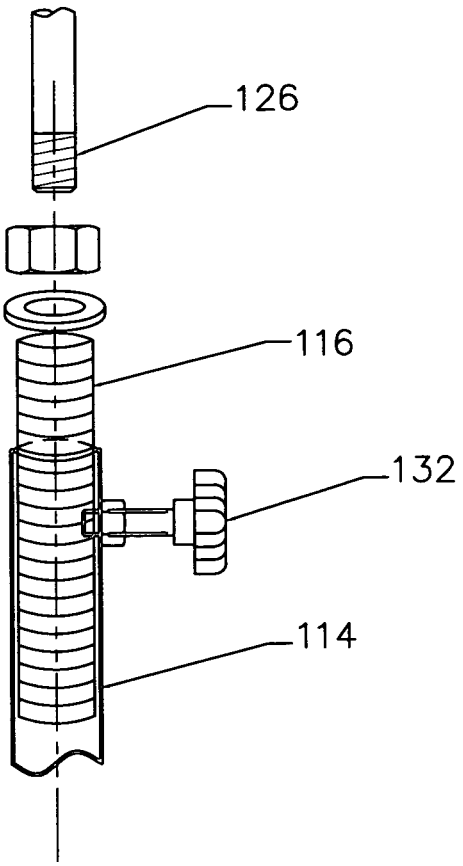
FIG. 4 illustrates a sectioned view of an exemplary spring portion partially enclosed by an exemplary tubular portion, in accordance with an embodiment of the present invention.

FIG. 4 illustrates a sectioned view of an exemplary spring portion partially enclosed by an exemplary tubular portion, in accordance with an embodiment of the present invention. In some embodiments, the elasticity of the spring portion, along with the elevation of the ball over a ground surface, may be variably adjusted by traversing the spring portion through different sections of the longitudinal axis of the rigid tubular portion. Those skilled in the art, in light of the present teachings will recognize that as greater portions of the spring portion are enclosed in the rigid tubular portion, the elasticity of the spring portion may decrease, and the elevation of the ball may rise. The tubular portion may secure in a predetermined position along the longitudinal axis of the spring portion with a tubular portion fastener. The tubular portion fastener may include, without limitation, a screw, a bolt, a washer, a magnet, and an adhesive. In one alternative embodiment, the tubular member may include various attaching mechanisms, including, without limitation, a threaded steel shaft, two steel plates with holes through plates able to travel up and down steel shaft, two steel nuts on shaft first situated above top plate second nut located under second plate creating a locking jaw. In some embodiments, an object may be securely fastened between the locking jaws with bolts that tighten against each other to lock the tubular portion in place. However, in other embodiments, different locking mechanisms may also be used to attach the tubular portion to an object either in the ground or joined to a stationary object.

Figure 5:
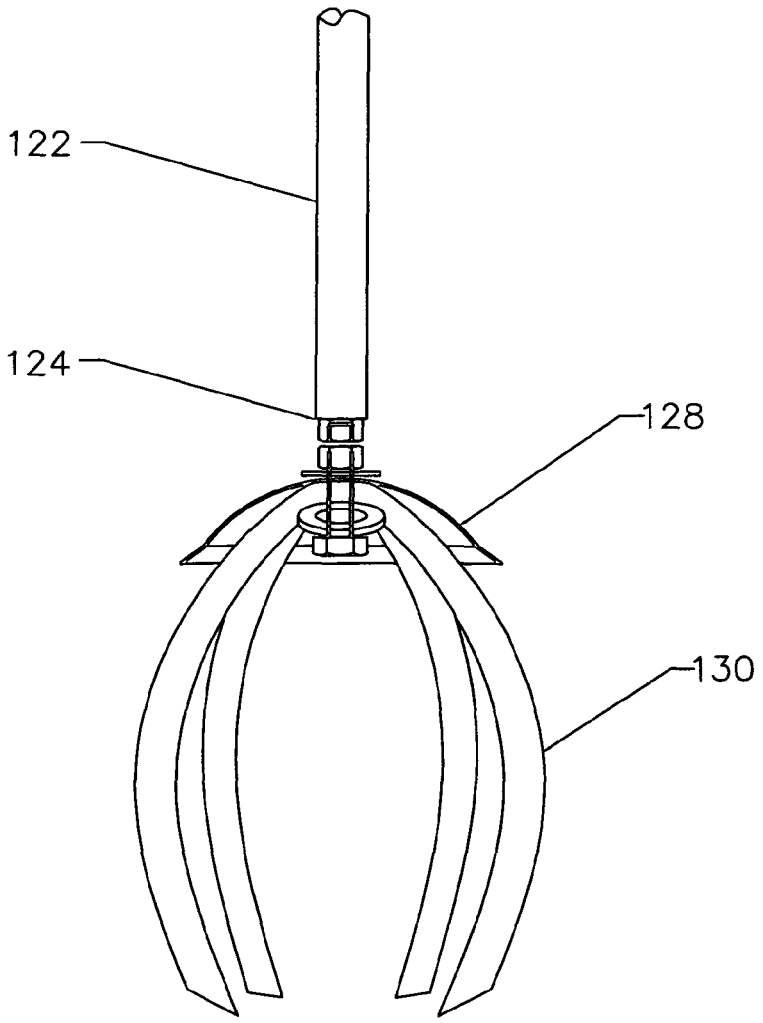
FIG. 5 illustrates a close up view of an exemplary telescoping arm portion joined to an exemplary ball attachment portion, in accordance with an embodiment of the present invention.

FIG. 5 illustrates a close up view of an exemplary telescoping arm portion joined to an exemplary ball attachment portion, in accordance with an embodiment of the present invention. In some embodiments, the ball attachment portion may act as a ball harness to securely join the ball to the telescoping arm portion. In some embodiments, the ball attachment portion may include a central shank with an annular flange at one end and a truncated conical section at the other end. A rod may pass through the ball to affix to the annular flange, thereby creating a secure attachment. However, in other embodiments, the ball may securely join with the ball attachment portion through various means, including, without limitation, an adhesive, a rope passing through the ball, and an expanding screw. Those skilled in the art will readily recognize, in light of the teaching of the present invention, the ball may receive numerous large and impactful blows, thereby requiring a secure attachment to the ball attachment portion. Likewise, the ball attachment portion must securely attach to the ball end of the telescoping arm portion.

In one embodiment of the present invention, the spring portion may not be necessary. The telescoping arm portion would attach to the ball by means of a solid steel or plastic ball bearing held within a restricted area, and held firmly in place on the tubular portion. In this manner, movement of the telescoping arm portion and the ball may occur without the use of the spring portion. In yet another embodiment, the ball end of the telescoping arm portion may attach to a movable ball bearing. The ball bearing may attach to the tubular portion through an aperture in the center of the ball bearing, which rests over the tubular portion and may rotate about a stationary base when the user strikes the ball.

Figure 6:
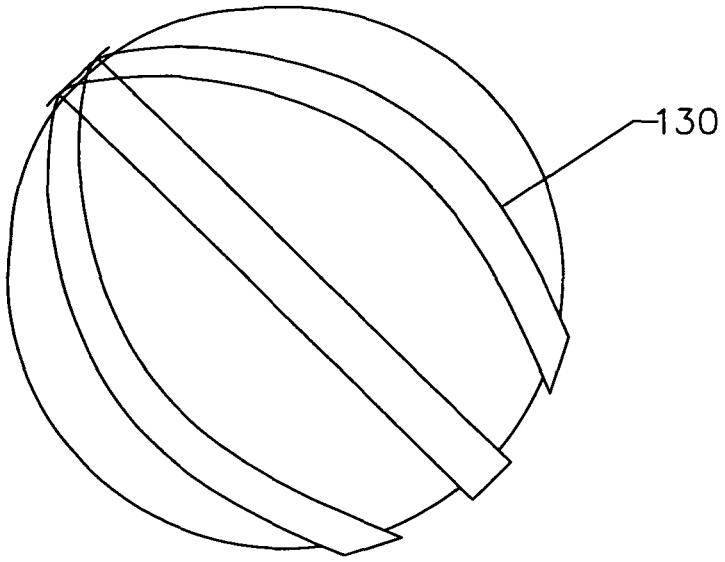
FIG. 6 illustrates a detailed perspective view of an exemplary ball, in accordance with an embodiment of the present invention.

FIG. 6 illustrates a detailed perspective view of an exemplary ball, in accordance with an embodiment of the present invention. In some embodiments, the ball may include, without limitation, a rubber ball, a leather ball, a baseball, a football, a soccer ball, a hockey puck, a golf ball, a croquet ball, and the like. However, in other embodiments, the ball may refer to any sports related member that is commonly propelled forward, including, without limitation, a hockey puck and a shuttlecock. A ball attachment portion may act as a ball harness to securely join the ball to the telescoping arm portion.

Figure 7:
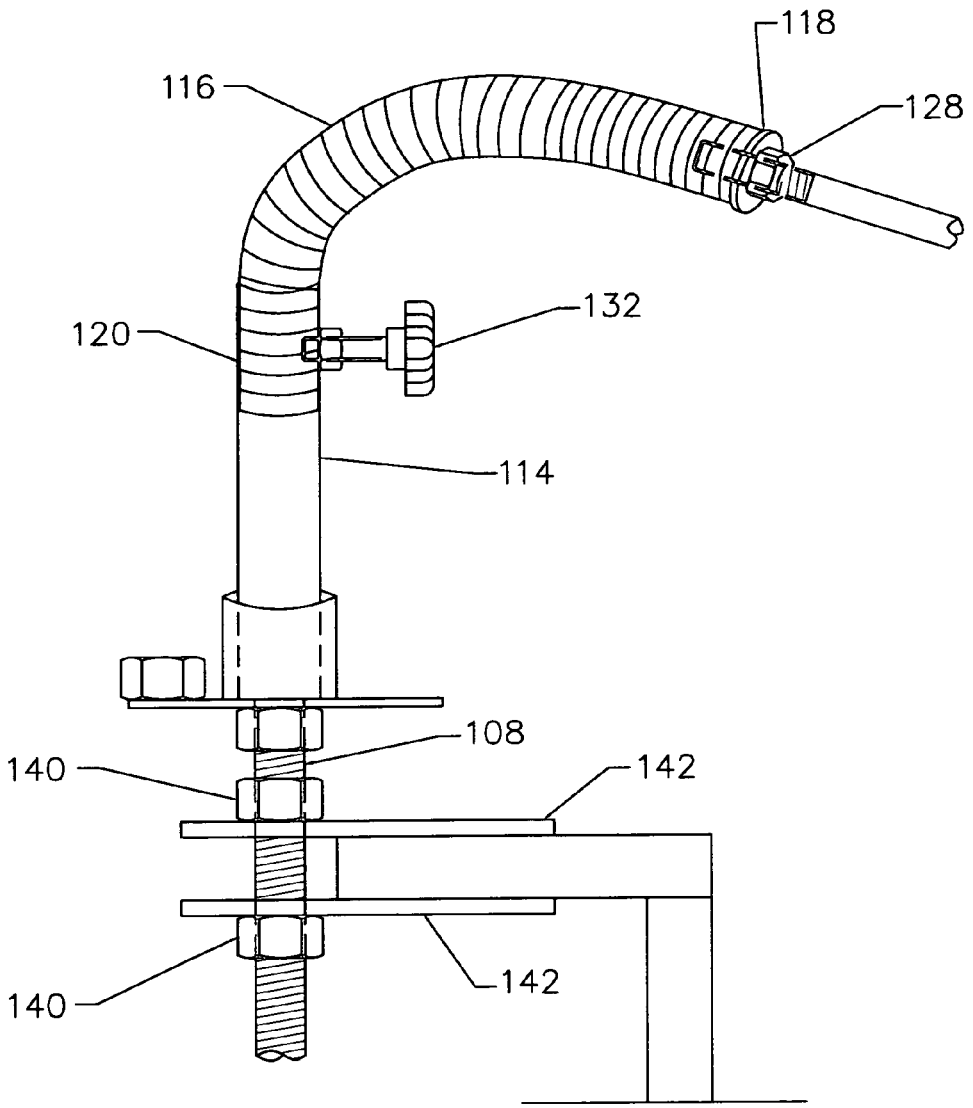
FIG. 7 illustrates a detailed perspective view of an exemplary base shaft that utilizes a clamp, rather than the base to secure to an anchored object, in accordance with an embodiment of the present invention.

FIG. 7 illustrates a detailed perspective view of an exemplary base shaft that utilizes a clamp 142, rather than the base to secure to an anchored object, in accordance with an embodiment of the present invention. In some embodiments, the clamp may supplant the base portion, acting as a fastening device to hold or secure the base shaft tightly together and prevent movement or separation through the application of inward pressure. A pair of nuts 140 may position on either side of the clamp to create a locking jaw that secures the clamp on to the anchored object. The clamp may include, without limitation, a band clamp, a bar clamp, a C-clamp, and a gripe.

Figure 8A:
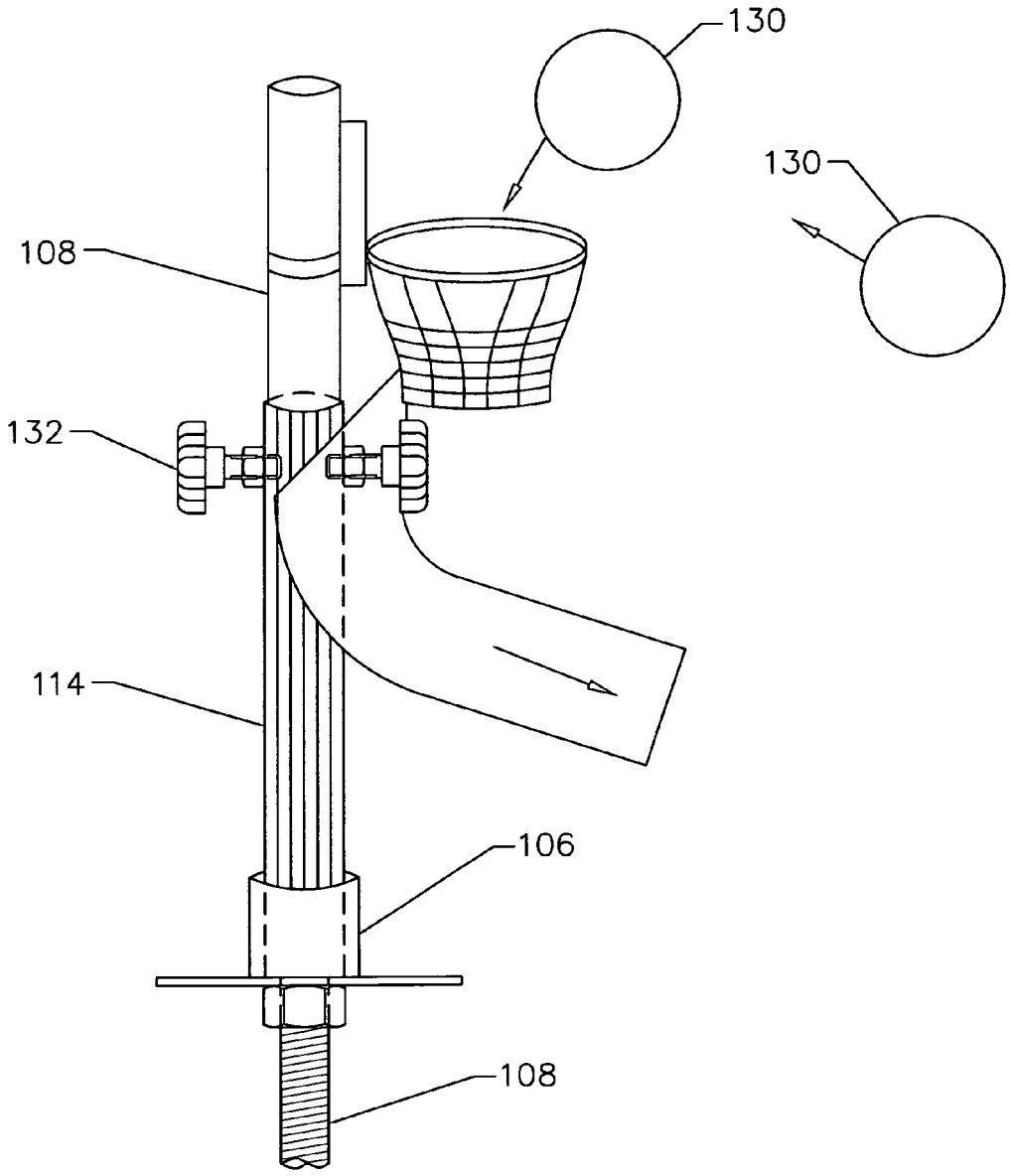
FIGS. 8A, 8B, and 8C illustrate detailed perspective views of an exemplary sports ball training assembly with various attachments for different sports, in accordance with an embodiment of the present invention.
Figure 8B:
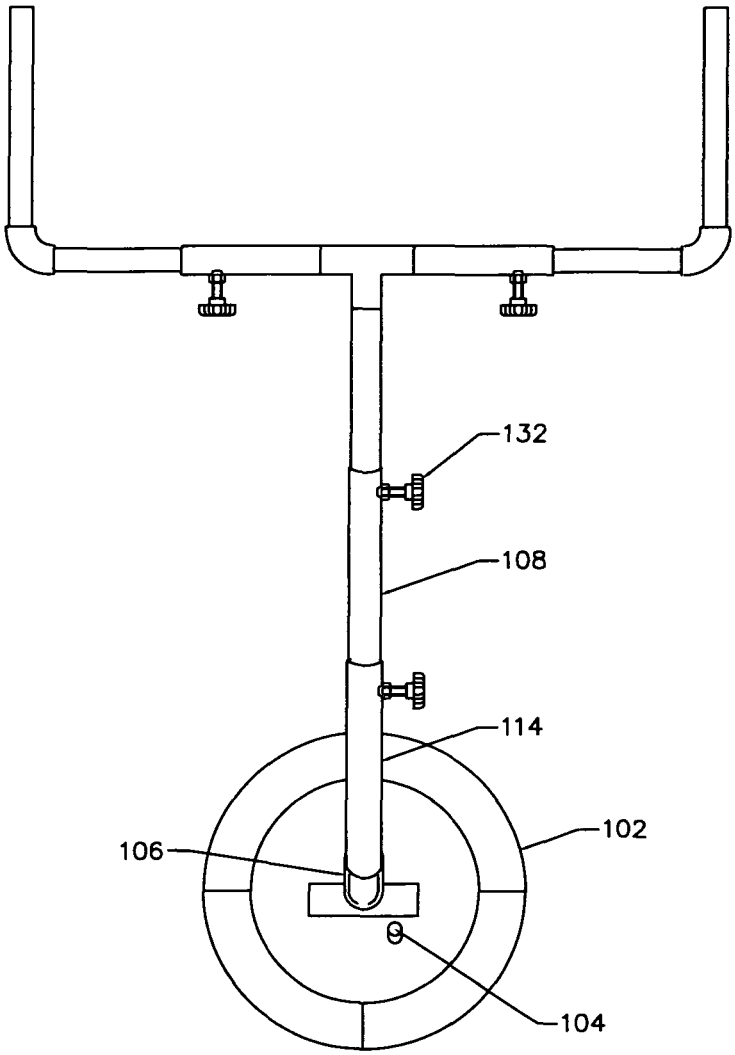
Figure 8C:
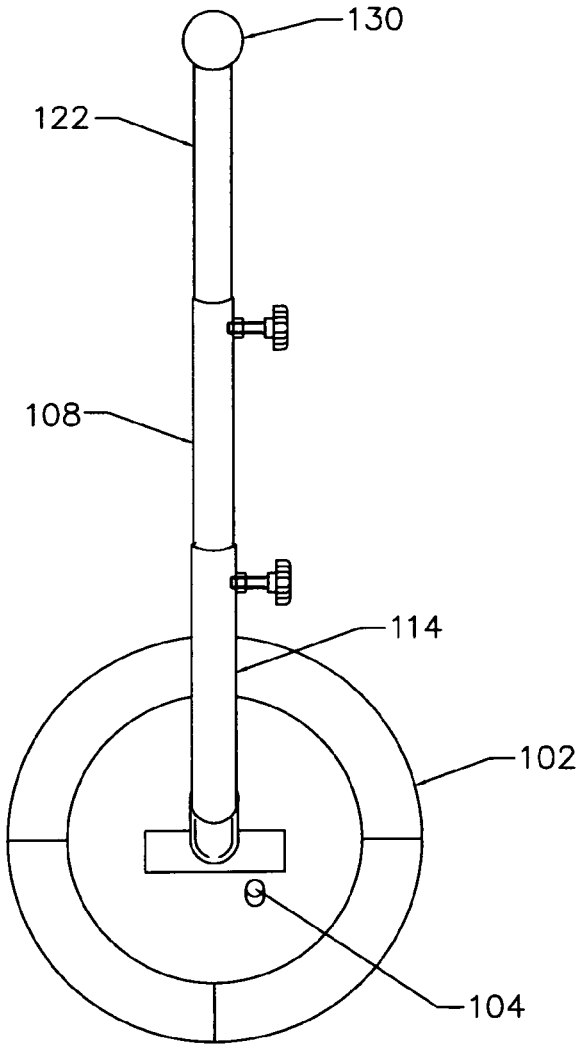

FIGS. 8A, 8B, and 8C illustrate detailed perspective views of an exemplary sports ball training assembly with various attachments for different sports, in accordance with an embodiment of the present invention, where FIG. 8A illustrates an exemplary sports ball training assembly with a basketball backboard and hoop joined to a distal end of an exemplary base shaft, FIG. 8B illustrates an exemplary sports ball training assembly with a football field goal joined to a distal end of an exemplary base shaft, and FIG. 8C illustrates an exemplary sports ball training assembly with a tee for a baseball joined to a distal end of an exemplary base shaft. The sports ball training assembly may include ancillary tools and devices to support and enhance the primary function of repetitive ball propulsion. In this manner, the ancillary tools may work in conjunction with the ball, creating an additional objective during training. FIG. 8A includes a basketball backboard and hoop that joins with the distal end of the base shaft. Those skilled in the art, in light of the present teachings, will recognize that the elevation of the basketball backboard and hoop may be adjusted to accommodate various ages and skill levels. In some embodiments, a return mechanism may channel the basketball away from the shaft base and towards the user after the ball passes through the basketball hoop. Those skilled in the art will readily recognize, in light of the teaching of the present invention, that as the user stands in front of the ball return mechanism and throws the ball toward basketball backboard and hoop, the ball passes through the net and automatically channels towards the user, thereby allowing for repetitive practice. In some embodiments, the basketball backboard and hoop may utilize numerous fasteners to attach to the base shaft, including, without limitation, clams, brackets, bolts, screws, flanged nuts, washers, rope, and adhesives. In one embodiment, a cylindrical bracket locking mechanism may attach to a basketball backboard from a rear position. A pair of rivets may pass through the front of backboard holding the cylindrical bracket in place. A nut in an outside location over a hole on the locking mechanism along with a locking bolt may secure the backboard in place onto a cylindrical shaft. The backboard may then be able to accommodate a basketball hoop with two locking mechanisms located in the rear of the backboard. The locking mechanisms position around the tubular portion with a nut and a threaded bolt positioned over a hole in the center. The basketball hoop may pass through holes in backboard, lining up with the rear backboard locking mechanism. In some embodiments, the basketball hoop may also accommodate a net around the outer perimeter. FIG. 8B includes a football field goal that joins with the base shaft, in proximity to the distal end. In some embodiments, the football field goal may include, without limitation, a net to catch the football, a planar barrier to repel the football, and a planar barrier with an aperture sized to receive the football, wherein the objective of accurately kicking the football through the aperture is attempted. FIG. 8C includes a baseball tee that positions at the extreme end of the distal end. The sports ball training assembly may include a tee for supporting a baseball or softball. In this manner, the baseball may rest on the tee, and the user may utilize a bat to strike the baseball.

Figure 9:
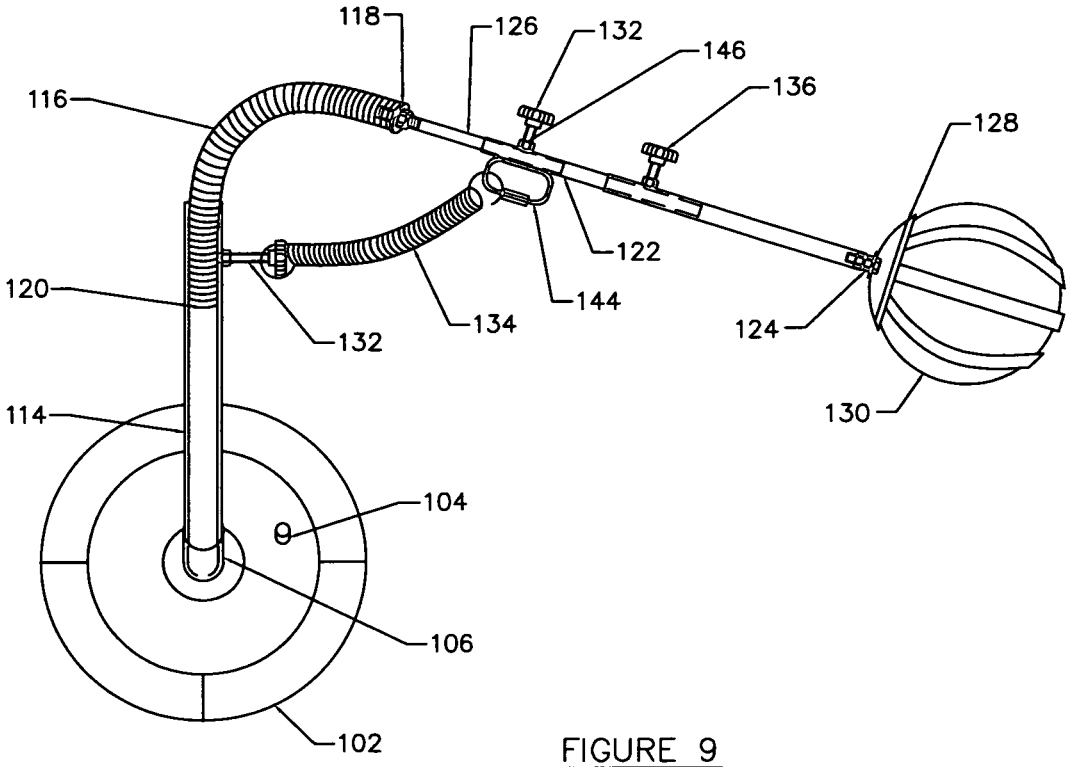
FIG. 9 illustrates a detailed perspective view of an exemplary sports ball training assembly that utilizes an additional spring portion for enhanced stability and control of the ball, in accordance with an embodiment of the present invention.

FIG. 9 illustrates a detailed perspective view of an exemplary sports ball training assembly that utilizes an additional spring portion for enhanced stability and control of the ball, in accordance with an embodiment of the present invention. The additional spring portion also functions to allow the ball to return to the user. In some embodiments, an additional spring portion may join from each end to the tubular portion fastener, and the fastener located on the telescoping arm portion. The additional spring portion may provide tighter control of the ball by providing increased compressibility to force the ball towards the sports ball training assembly. Those skilled in the art, in light of the present teachings, will recognize that adding even greater amounts of spring portions, with each spring portion having a different elasticity creates directional movement of the ball. For example, without limitation, the ball may only return to the sports ball training assembly in one direction, yet may be propelled from numerous angles.

Figure 10A:
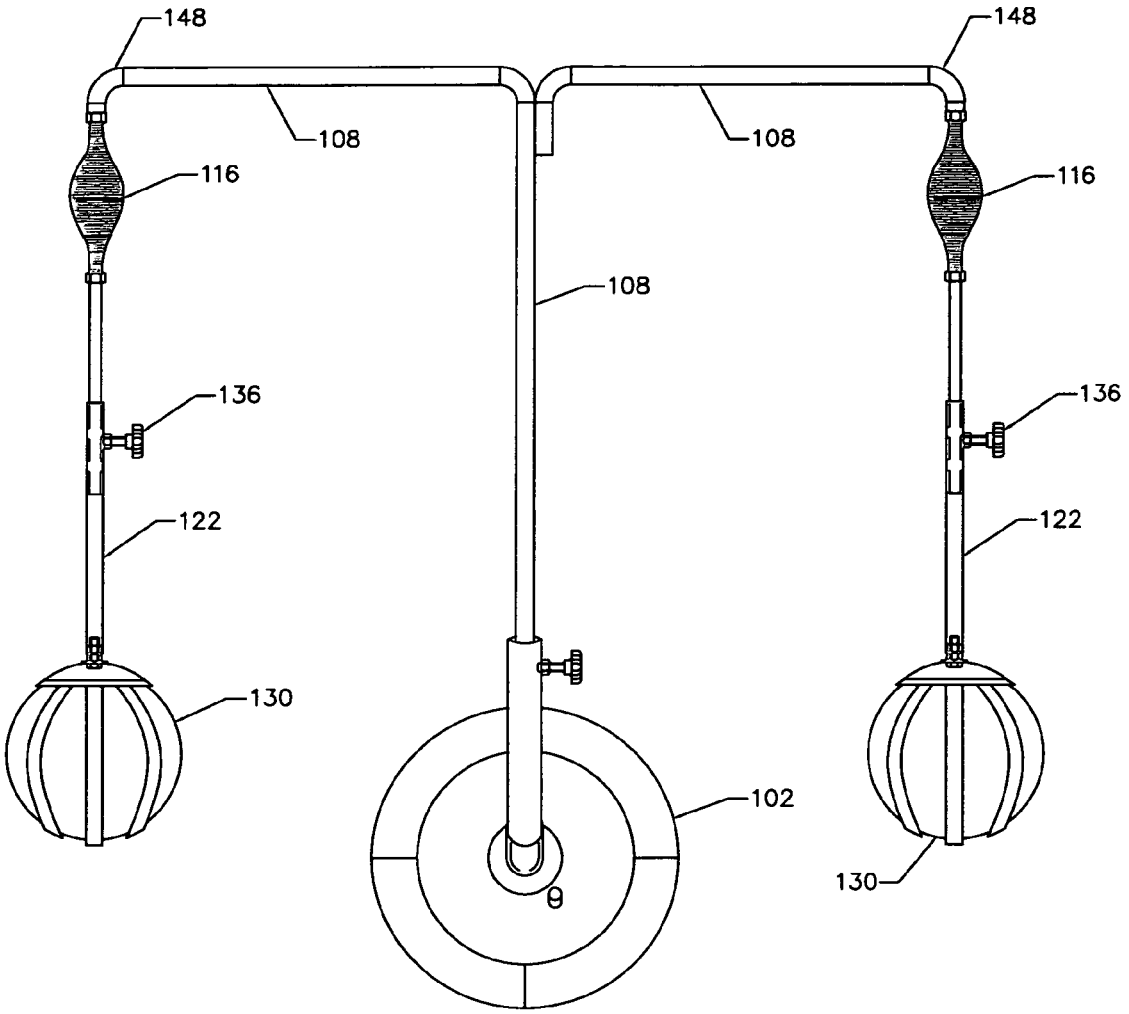
FIGS. 10A, 10B, and 10C illustrate detailed perspective views of an exemplary sports ball training assembly with two and four balls attached respectively, in accordance with an embodiment of the present invention, where
Figure 10B:
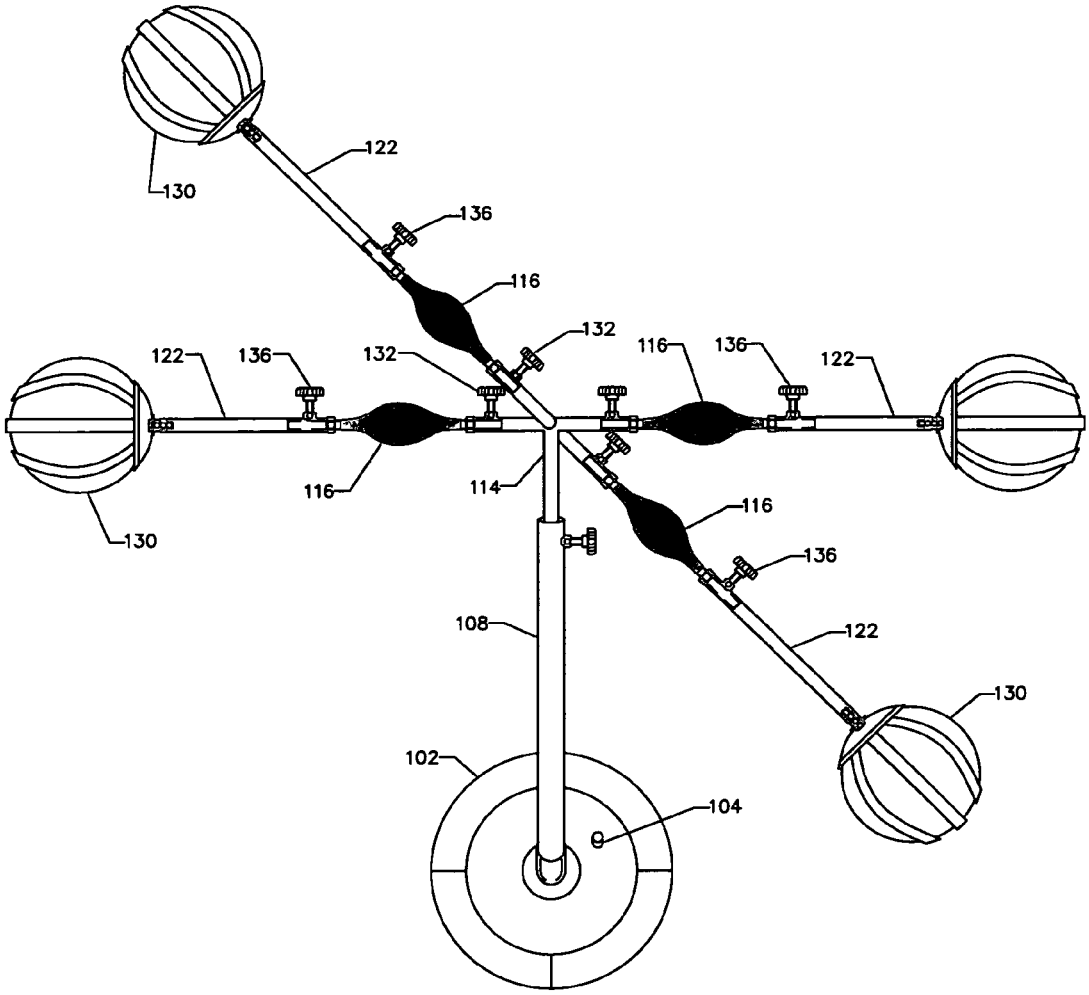
Figure 10C:
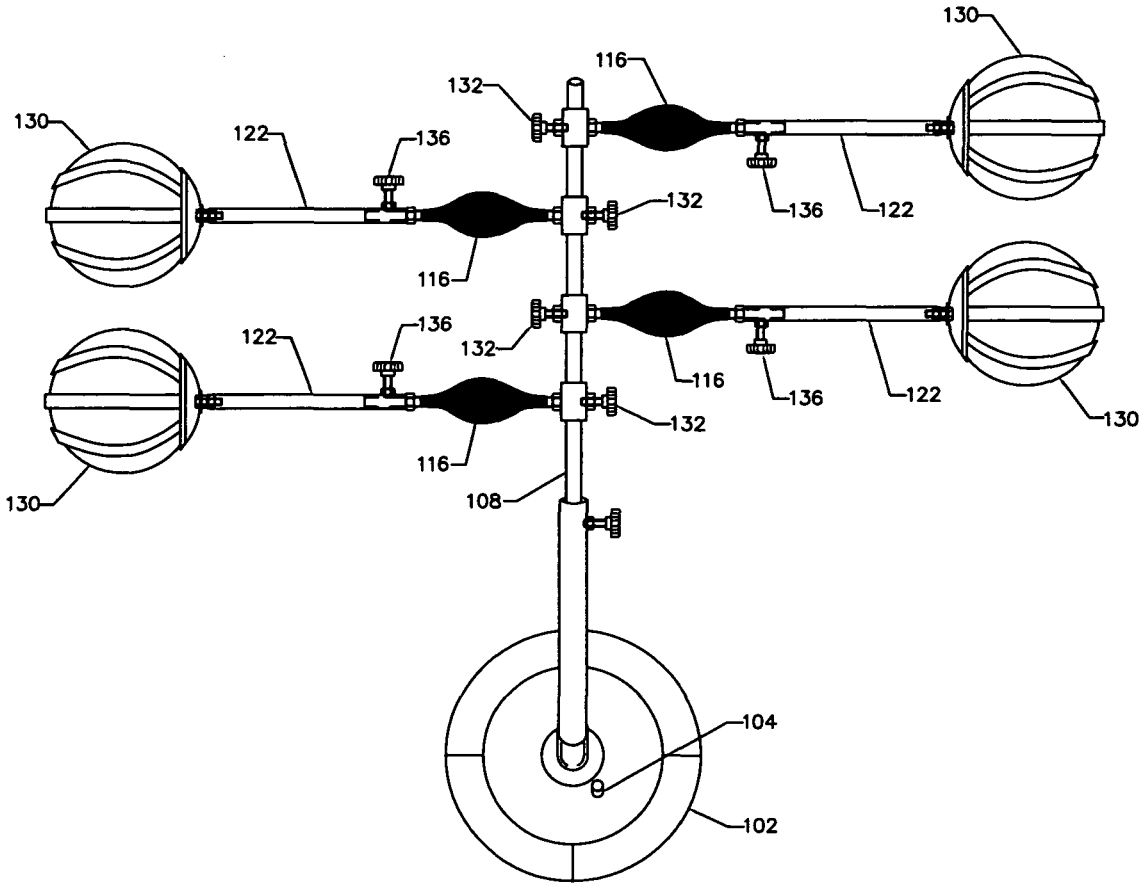

FIGS. 10A, 10B, and 10C illustrate detailed perspective views of an exemplary sports ball training assembly with two and four balls attached respectively, in accordance with an embodiment of the present invention, where FIG. 10A illustrates an exemplary sports ball training assembly with two balls, spring portions, and telescoping arm portions, FIG. 10B illustrates an exemplary sports ball training assembly with four balls, spring portions, and telescoping arm portions, and FIG. 10C illustrates a variable configuration of an exemplary sports ball training assembly with four balls, spring portions, and telescoping arm portions. In some embodiments, two balls, four balls, six balls, or even a larger multiplicity of balls may create a competitive training environment. The multiplicity of balls may also allow multiple users to strike the balls simultaneously or back and forth to each other. In one embodiment, an angled coupling 148 may be utilized between the spring portion and the base shaft to provide additional flexibility. The angled coupling may include, without limitation, a 45 degree coupling, an elbow, and an L-pipe. Those skilled in the art, in light of the present teachings, will recognize that the angled coupling may be utilized with numerous variations of the sports ball training assembly, including, without limitation, with a standard base portion, with a clamp, and with a multiplicity of balls. In this manner, the most efficient configuration for training may be applied. However, in other embodiments, the angle provided by the angled coupling may not be utilized in the clamp version of the base portion, or with the multiplicity of balls.

Figure 11:
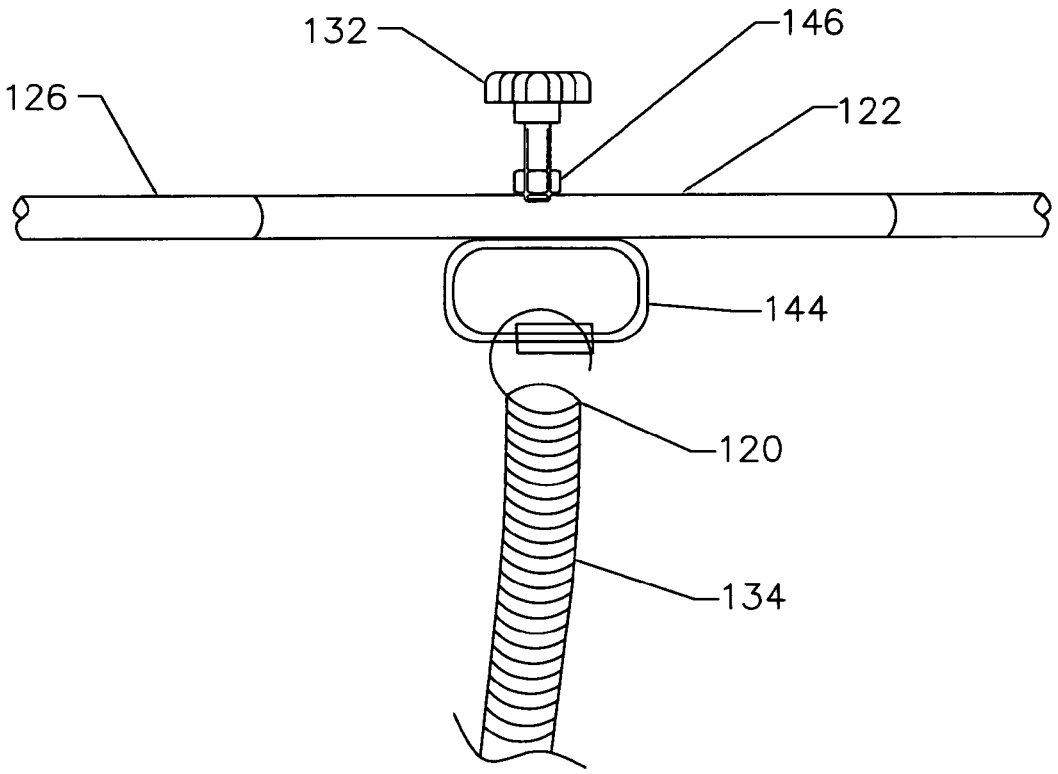
FIG. 11 illustrates a detailed perspective view of an exemplary second spring portion, in accordance with an embodiment of the present invention.

FIG. 11 illustrates a detailed perspective view of an exemplary second spring portion, in accordance with an embodiment of the present invention. In some embodiments, the sports ball training assembly may utilize a second spring portion 134 for enhanced stability and control of the ball. The second spring portion may also function to allow the ball to return to the user. Those skilled in the art, in light of the present teachings, will recognize that the second spring portion also includes an impact end, closer to the ball, and a support end that joins with the base shaft through a hook portion 144. In some embodiments, the fastener may utilize a fastener nut 146 to tighten the tubular portion.

In one alternative embodiment, the sports ball training assembly may include an automated base shaft that moves from side to side to create a more challenging training activity. In this manner, the ball is more difficult to strike, and the user may require greater agility and hand-eye coordination to strike the ball. In yet another embodiment, base shaft may include sufficient buoyancy to float. In this manner, the user may utilize the sports ball training assembly in a swimming pool or at the beach.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation.

Having fully described at least one embodiment of the present invention, other equivalent or alternative methods of implementing a sports ball training assembly for repetitively striking a ball in a small area according to the present invention will be apparent to those skilled in the art. Various aspects of the invention have been described above by way of illustration, and the specific embodiments disclosed are not intended to limit the invention to the particular forms disclosed. The particular implementation of the a sports ball training assembly for repetitively striking a ball in a small area may vary depending upon the particular context or application. By way of example, and not limitation, the a sports ball training assembly for repetitively striking a ball in a small area described in the foregoing were principally directed to repetitive striking of a sports related ball to practice technique and enhance motor skills implementations; however, similar techniques may instead be applied to a ride at a carnival that oscillates the riders between two extreme points, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A sports ball training assembly comprising:

a ball;

a ball attachment portion, said ball attachment portion being configured to join with said ball;

a telescoping arm portion, said telescoping arm portion comprising a ball end, said telescoping arm portion further comprising a spring end, said telescoping arm portion comprises a spring returns mechanism, said spring return mechanism comprising a hook portion;

wherein said spring return mechanism is operable to lock in various locations along the longitudinal axis of said telescoping arm portion for returning said ball back to said equilibrium position;

a spring portion, said spring portion comprising an impact end, said spring portion further comprising a support end, said spring portion being operable to return said ball to an equilibrium position from a forward position, said spring portion being further operable to position said ball at a predetermined elevation;

a base shaft, said base shaft comprising a distal end, said base shaft further comprising a base end;

a base portion, said base portion comprising an aperture, said base portion further comprising a reinforcing portion; and a tubular portion, said tubular portion being configured to substantially surround said base shaft, said tubular portion being further configured to surround a predetermined section of said spring portion, said spring portion being operable to traverse through a longitudinal axis of said tubular portion for affecting elasticity of said spring portion and elevation of said ball, said tubular portion comprising a tubular portion fastener, said tubular portion fastener being configured to secure said tubular portion at a predetermined position along the longitudinal axis of said spring portion.

2. The sports ball training assembly of claim 1, wherein the movement of said ball is affected by said tubular portion.

3. The sports ball training assembly of claim 2, wherein said spring portion traverses along the longitudinal axis of said tubular portion to affect the elasticity of said spring portion.

4. The sports ball training assembly of claim 3, wherein said spring portion traverses along the longitudinal axis of said tubular portion to affect the elevation of said ball.

5. The sports ball training assembly of claim 4, wherein said telescoping arm portion extends and retracts in relation to said base shaft, said telescoping arm portion comprising a joint to provide flexibility for connection with said spring end.

6. The sports ball training assembly of claim 5, wherein said reinforcing portion resists articulation of said base shaft towards said forward position, and causes said base shaft to return to said equilibrium position.

7. The sports ball training assembly of claim 6, wherein said reinforcing portion prevents said tubular portion from rotating when a substantial torque is applied.

8. The sports ball training assembly of claim 7, wherein said sports ball training assembly comprises a second spring portion.

9. The sports ball training assembly of claim 8, wherein said second spring portion positions between said telescoping arm portion and said base shaft.

10. The sports ball training assembly of claim 9, in which said base shaft comprises an angled coupling, said angled coupling comprising 45 degrees.

11. The sports ball training assembly of claim 10, wherein said base shaft is configured to provide a substantially rigid support for said sports ball training assembly.

12. The sports ball training assembly of claim 11, in which said base portion comprises an aperture nut, said aperture nut being operable to cover said aperture, said base portion further comprising a base plate, said base plate being configured to provide stability, said base plate comprising a base plate nut, said base plate nut being configured to fasten said base plate to a ground surface.

13. The sports ball training assembly of claim 12, in which said base plate comprises a clamp, said clamp comprises a pair of nuts, said pair of nuts being configured to press against said clamp.

14. The sports ball training assembly of claim 1, in which said sports ball training assembly comprises a multiplicity of balls in which said sports ball training assembly comprises a multiplicity of telescoping arm portions.

15. The sports ball training assembly of claim 1, in which said ball comprises a multiplicity of sizes and dimensions.

* * * * *